US005647469A

United States Patent [19]

Yamagishi et al.

[11] Patent Number: 5,647,469

[45] Date of Patent: Jul. 15, 1997

[54] COIN SORTING DEVICE

[75] Inventors: Ryoji Yamagishi, Kawagoe; Yukio Itou, Sakado, both of Japan

[73] Assignee: Kabushiki Kaisha Nippon Conlux, Japan

[21] Appl. No.: 530,924

[22] Filed: Sep. 20, 1995

[30] Foreign Application Priority Data

| | | | |
|---|---|---|---|
| Sep. 27, 1994 | [JP] | Japan | 6-231580 |
| Sep. 27, 1994 | [JP] | Japan | 6-231581 |
| Sep. 27, 1994 | [JP] | Japan | 6-231582 |

[51] Int. Cl.[6] ..... G07D 5/08

[52] U.S. Cl. ..... 194/200; 194/318; 194/345

[58] Field of Search ..... 194/200, 202, 194/203, 318, 345, 347, 348

[56] References Cited

U.S. PATENT DOCUMENTS

| | | | |
|---|---|---|---|
| 2,327,154 | 8/1943 | Osborne | 194/200 |
| 4,565,275 | 1/1986 | Hagiwara . | |
| 4,601,380 | 7/1986 | Dean et al. . | |
| 4,666,027 | 5/1987 | Ostroski et al. | 194/203 |
| 4,690,264 | 9/1987 | Yokomori | 194/317 |

FOREIGN PATENT DOCUMENTS

| | | | |
|---|---|---|---|
| 373948 | 12/1989 | European Pat. Off. . | |
| 54-20797 | 2/1979 | Japan | 194/345 |
| 58-38833 | 8/1983 | Japan . | |
| 59-13797 | 3/1984 | Japan . | |
| 61-152183 | 9/1986 | Japan . | |
| 63-27251 | 7/1988 | Japan . | |
| 2-217986 | 8/1990 | Japan . | |
| 4-55996 | 2/1992 | Japan . | |
| 4-317192 | 11/1992 | Japan . | |
| 2144252 | 7/1983 | United Kingdom . | |
| 2152208 | 12/1983 | United Kingdom . | |
| 2221332 | 6/1989 | United Kingdom . | |

*Primary Examiner*—F. J. Bartuska
*Attorney, Agent, or Firm*—Diller, Ramik & Wight, PC

[57] ABSTRACT

The coin sorting device is equipped with a coin passage which guides coins that are inserted via a coin insertion opening, a gate plate for opening and closing the coin passage, a coin jamming detection sensor which is installed at an intermediate point in the coin passage, for detecting the jamming of coins passing through the coin passage, and a gate plate opening mechanism which is actuated by a detection signal from the detection sensor, and which automatically opens and closes the gate plate.

4 Claims, 12 Drawing Sheets

COIN SORTING DEVICE

BACKGROUND OF THE INVENTION

1. Field of the Invention

The present invention relates to a coin sorting device used in automatic vending machines, change machines, service devices and the like.

2. Description of the Related Art

Generally, coin sorting devices which determine whether inserted coins are genuine or counterfeit, and which sort the coins so that counterfeit coins are sent into a specially designated coin passage, and so that genuine coins are sent into respective specially designated coin passages according to denomination, are mounted in devices such as automatic vending machines, change machines, service devices and the like.

FIG. 10 is a front view depicting a conventional coin sorting device 1.

This coin sorting device 1 is constructed from a main body 2, a gate plate 3 which covers the upper front portion of the main body 2 such that the gate plate 3 can be opened and closed, and a front cover 4 which covers the lower front portion of the main body 2.

A plurality of coin passages (not shown in the figures) and a plurality of coin distributing levers (not shown in the figures) which distribute inserted coins into this plurality of coin passages are disposed between the lower portion of the main body 2 and the front cover 4 which covers this lower portion.

A coin insertion opening 17, and a first coin passage 5 (inclined downward toward the right with respect to the figure) which guides coins that are inserted via the coin insertion opening 17, are formed between the main body 2 and the gate plate 3 which covers the upper portion of the main body 2 such that the gate plate 3 can be opened and closed.

An electronic coin discriminating means 6 which ascertains the genuineness of coins passing through and the denomination of genuine coins is disposed at an intermediate point in the first coin passage 5.

As is shown in FIG. 12, which is a schematic section along line AA in FIG. 10, the coin discriminating means 6 is constructed from an oscillating coil 7 and a receiving coil 8 which are disposed on both sides of the first coin passage 5 so that a prescribed gap (a gap which allows the passage of a single coin 9) is left between the two coils.

The oscillating coil 7 is disposed inside a box 10 which is separate from the gate plate 3, and the box 10 is supported on a shaft 11 which is disposed at the upper end of the box 10 such that the box 10 is free to pivot relative to the main body 2.

The box 10 is constantly driven in the direction which separates the box 10 from the main body 2 by a coil spring 12 which is wound around the shaft 11.

The box 10 is constantly urged toward the main body 2 by the driving force of the gate plate 3 which covers the upper portion of the main body 2, so that the lower end 10*a* of the box 10 forms a portion of the bottom surface of the first coin passage 5.

As is shown in FIG. 10, the gate plate 3 is supported on a shaft 13 which is disposed on the right side of the main body 2, so that the gate plate 3 is free to pivot about the shaft 13 relative to the main body 2. Furthermore, the gate plate 3 is constantly driven toward the main body 2 by a spring 14 which is wound around the shaft 13, so that the gate plate 3 is caused to contact the main body 2, thus regulating the opening of the first coin passage 5 which is formed by the main body 2 and gate plate 3.

A gate lever 15 which causes the gate plate 3 to move away from the main body 2 against the driving force of the coil spring 14 that drives the gate plate 3 toward the main body 2 is disposed at the upper end of the main body 2.

As is shown in FIG. 11, which is a plan view of the coin sorting device 1, the gate lever 15 is supported on a shaft 16 so that the gate lever 15 is free to pivot relative to the main body 2, and a projection 15*a* is formed on the front surface of the gate lever 15.

The gate lever 15 is driven by the driving force of a coil spring 18 wound around the shaft 16, so that the projection 15*a* is constantly positioned in a position separated from the gate plate 3 as shown in FIG. 10.

As is shown in FIG. 11, a tapered member 19 whose thickness increases in the downward direction is formed on a portion of the back surface of the gate plate 3 beneath the projection 15*a*. Accordingly, when the gate lever 15 shown in FIG. 10 is forcibly rotated in the clockwise direction, the projection 15*a* on the gate lever 15 contacts the tapered member 19 (FIG. 11), so that the gate plate 3 is caused to rotate in the counterclockwise direction about the shaft 13 as indicated by arrow B in FIG. 13. As a result, the bottom surface of the first coin passage 5 is opened.

As a result of the rotation of the gate plate 3, the box 10 accommodating the oscillating coil 7 of the coin discriminating means 6 is also separated from the main body 2 by the driving force of the coil spring 12 as shown in FIG. 14. Accordingly, the bottom surface of the first coin passage 5 formed by the lower end 10*a* of the box 10 is opened, so that the coin 9 stuck in the first coin passage 5 is allowed to drop.

Thus, when the gate lever 15 shown in FIG. 10 is forcibly rotated in the clockwise direction, the gate plate 3 and the box 10 accommodating the oscillating coil 7 of the coin discriminating means 6 spread apart as shown in FIGS. 13 and 14, so that the entire bottom surface of the first coin passage 5 is opened. Accordingly, as is shown in FIG. 15, the coin C which was clamped between the oscillating coil 7 and receiving coil 8 of the coin discriminating means 6 (FIG. 12), and the following coin D, drop downward from the bottom surface of the first coin passage 5. Furthermore, the coins which have thus dropped are captured by coin discharge chutes 4*a*, 4*b* formed in the front cover 4 which covers the lower portion of the main body 2, and are discharged to a coin discharge opening (not shown in the figures) formed in the device in question, such as an automatic vending machine or the like.

A reference number 20 in FIGS. 10 and 15 indicates a gate rail which changes the direction of advance of coins dropped in via the coin insertion opening 17.

The operation of the gate lever 15 described above is performed by the user in order to release coins C, D passing through the first coin passage 5 when the coins have become stuck (mainly in the coin discriminating means 6) as a result of deformation or soiling as shown in FIG. 15.

However, in cases where the user continues to insert coins without noticing that a coin has become stuck at an intermediate point in the first coin passage 5, the inserted coins accumulate in the first coin passage 5. As a result, even if the user finally notices that a number of coins have become stuck at an intermediate point in the first coin passage 5, and operates the gate lever 15, it may be impossible to release the stuck coins. Accordingly, there is a danger that the functioning of the coin sorting device 1 itself will be stopped.

In the coin sorting device 1 described above, as is shown in FIG. 16 (in which parts that are the same as in FIG. 15 are labeled with the same symbols), it is possible to release not only coins stuck inside the first coin passage 5, but also a plurality of coins F stuck in the entrance portion of the coin insertion opening 17, as follows: specifically, by forcibly rotating the gate lever 15 in the clockwise direction so that the gate plate 3 is opened, it is possible to guide the plurality of coins F (in the same manner as the coin D in FIG. 15) into the coin discharge chutes 4*a*, 4*b* of the front cover 4 via a return passage 2*a* with a projecting bent portion 2*b* formed in the main body 2, and to discharge the coins F to the outside of the device 1 from there.

However, if a plurality of coins F stuck in the entrance portion of the coin insertion opening 17 as shown in FIG. 16 all drop at the same time when the gate plate 3 is opened, the coins F will drop simultaneously while overlapping in the direction of thickness as shown in FIG. 17, which is a schematic sectional view along line BB in FIG. 16. As a result, the overlapping coins F will be unable to pass simultaneously through the projecting bent portion 2*b* of the narrow return passage 2*a*, and this will again cause coin jamming in this area, i.e., in the projecting bent portion 2*b* of the return passage 2*a*.

It might be thought that it would be possible to eliminate coin jamming in the bent portion 2*b* of the return passage 2*a* merely by setting the opening angle of the gate plate 3 at a large value so that the width W between the return passage 2*a* and the gate plate 3 during coin return is increased.

In recent years, however, a shallower depth has been demanded in devices such as automatic vending machines and the like, so that such machines can be installed without protruding into thoroughfares such as pedestrian walkways and the like. A much shallower depth is also required in the coin sorting devices installed in such machines; accordingly, it is difficult to insure a large width W between the return passage 2*a* and the gate plate 3 during coin return merely by increasing the opening angle of the gate plate 3. On the contrary, the achievement of such a shallower depth tends to result in a narrower width W between the return passage 2*a* and the gate plate 3 during coin return, so that the above-mentioned problem of coin jamming in the projecting bent portion 2*b* of the return passage 2*a* becomes even more conspicuous.

Furthermore, a plurality of liquid guide grooves (not shown in the figures) which guide liquids flowing in via the coin insertion opening 17 downward are formed in the bent portion 2*b* of the return passage 2*a*, and a liquid capturing part (not shown in the figures) which captures liquids dropping downward from the liquid guide grooves is disposed beneath the liquid guide grooves, so that liquids flowing in via the coin insertion opening 17 are discharged to the outside of the coin sorting device 1 via this liquid capturing part.

SUMMARY OF THE INVENTION

An object of the present invention is to provide a coin sorting device which is designed so that stuck coins can be quickly and reliably discharged.

In the first invention of the present application, in order to achieve the abovementioned object, a coin sorting device comprising a coin passage for guiding coins inserted via a coin insertion opening, and a gate plate for opening and closing the coin passage is further provided with a coin jamming detection sensor provided at an intermediate point in the coin passage, for detecting jamming of coins passing through the coin passage and a gate plate opening means for opening the gate plate in accordance with a detection signal from the detection sensor.

In the coin sorting device of this first invention, when a coin becomes stuck in the coin passage, the stuck coin is detected by the coin jamming detection sensor, and the gate plate opening means is actuated by the detection signal of the coin jamming detection sensor so that the gate plate is opened, thus causing the coin stuck in the coin passage to drop downward so that the coin is released.

Furthermore, in the second invention of the present application, in order to achieve the abovementioned object, a coin sorting device comprising a coin passage for guiding coins inserted via a coin insertion opening, and a gate plate for opening and closing this coin passage is further provided with a coin jamming detection sensor provided at an intermediate point in the coin passage, for detecting jamming of coins passing through the coin passage; and a gate plate opening means comprising driving means comprising a motor which is actuated based on a detection signal of the detection sensor, an arm member which is driven by the driving means to perform a reciprocating motion in the horizontal direction, a projection formed on a base end portion of the arm member, a tapered member formed on a back surface of the gate plate, for opening the gate plate by making sliding contact therewith when the arm member performs a reciprocating motion, and a projection formed on the tapered member so as to protect toward the base end portion of the arm member, for opening the gate plate even further by contacting the projection formed on the base end portion of the arm member when the arm member performs a reciprocating motion.

In the coin sorting device of this second invention, when a coin becomes stuck in the coin passage, the stuck coin is detected by the coin jamming detection sensor, and the gate plate opening means is actuated by the detection signal of the coin jamming detection sensor so that the gate plate is opened, thus automatically causing the coin stuck in the coin passage to drop downward so that the coin is released. Furthermore, since the gate plate opening means is constructed from a tapered member formed on the back surface of the gate plate, a gate arm which makes sliding contact with the tapered member, a projection formed on the base end portion of the gate arm, and a projection which is formed on the tapered member so that it projects toward the base end portion of the gate arm, and since the gate plate opening means is designed so that the projection formed on the base end portion of the gate arm and the projection formed on the tapered member are caused to contact each other when the gate arm performs a reciprocating motion, the opening angle of the gate plate can be set at a much larger value. As a result, coins stuck in the coin passage can be reliably discharged.

Furthermore, in the third invention of the present application, in order to achieve the abovementioned object, a coin sorting device comprising a main body and a gate plate for covering the upper front portion of the main body such that the gate plate can be opened and closed, and a coin passage provided between the main body and the gate plate for guiding coins inserted via a coin insertion opening, wherein coins stuck in the coin passage are released by opening the gate plate so that the coins are caused to drop downward, is further provided with a step portion formed in the surface of the main body beneath the coin passage positioned directly underneath the coin insertion opening, the step portion being caused to strike at least one coin among a plurality of coins dropping downward from the coin insertion opening while overlapping in the direction of thickness.

In the coin sorting device of this third invention, even if a plurality of coins stuck in the vicinity of the entrance of the coin insertion opening drop downward while overlapping in the direction of thickness when the coins are caused to drop by opening the gate plate, a portion of at least one of the coins will strike against the step portion so that the overlapping of the coins is broken. Accordingly, the coins will drop smoothly downward through the coin passage one at a time, so that coin jamming is eliminated.

Other objects and merits of the present invention will easily be understood from the following detailed description and attached figures.

DESCRIPTION OF THE PREFERRED EMBODIMENTS

One embodiment of the coin sorting device of the present invention will be described in detail below.

Figure 1:
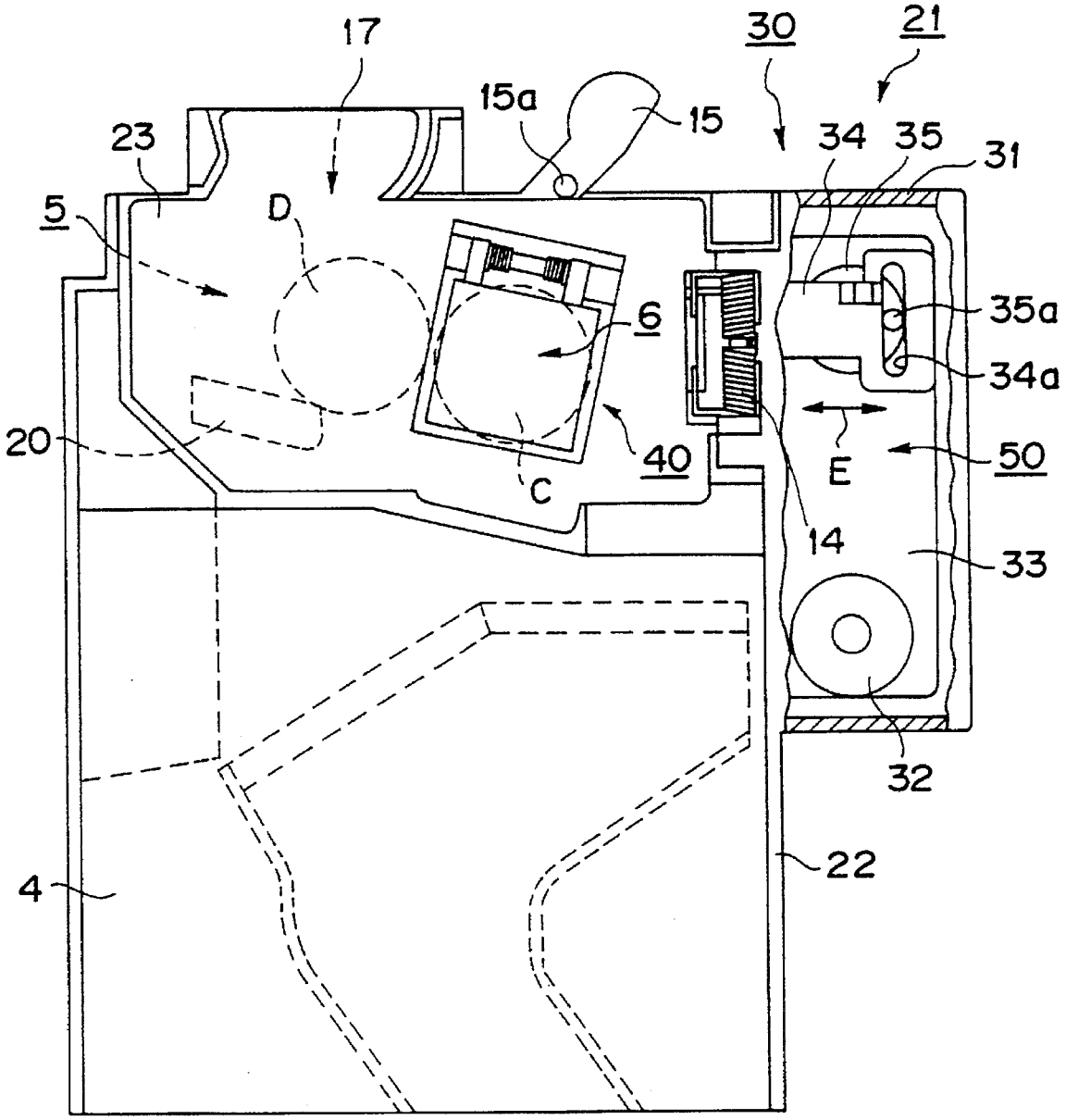
FIG. 1 is a partially sectional front view depicting a coin sorting device of the present invention.

FIG. 1 is a front view which depicts a coin sorting device 21 of the present invention. Parts which are the same as in FIGS. 10 through 17 are indicated by the same symbols.

Like conventional devices, the coin sorting device 21 is constructed from a main body 22 with a box structure, a gate plate 23 which covers the upper front portion of the main body 22 such that the gate plate can be opened and closed, and a front cover 4 which covers the lower front portion of the main body 22.

As in conventional devices, a plurality of coin passages which sort inserted coins (not shown in the figures) and a plurality of coin distributing levers (not shown in the figures) which distribute inserted coins into this plurality of coin passages are disposed between the lower portion of the main body 22 and the front cover 4 which covers the lower portion of the main body 22. Furthermore, as in the conventional device, a coin insertion opening 17 and a first coin passage 5 (inclined downward toward the right in the figures) which guides coins inserted via the coin insertion opening 17 are formed between the main body 22 and the gate plate 23 which covers the upper portion of the main body 22 such that the gate plate 23 can open and close.

A gate plate opening means 30 which automatically opens and closes the gate plate 23 is disposed on the right side of the main body 22. Furthermore, the gate plate opening means 30 is accommodated in a box 31 which protrudes from the right side of the main body 22.

The gate plate opening means 30 is constructed from a driving portion 50 which is accommodated inside the box 31, and a gate arm 34 (described later) which is driven by the driving portion 50.

The driving portion 50 is constructed from one driving motor 32 which is disposed in the lower portion of the box 31, a gear box 33 constructed from a plurality of gear trains which transmit the driving force of the motor 32, and a drive pulley 35 which is caused to rotate in one direction by the driving force of the motor 32 transmitted via the gear box 33.

A protection **35*a* is formed on the surface of the drive pulley 35. The projection 35*a* is inserted into a vertical slot 34*a* formed in the rear end of the gate arm 34**, which is supported so as to be able to perform a reciprocating motion in the left-right direction.

As a result of the use of such a structure consisting of a pulley 35 and gate arm 34, when the pulley 35 completes one revolution with the projection **35*a* of the pulley engaged in the slot 34*a*, the gate arm 34 is driven by the rotation of the pulley 35 so that the gate arm 34 performs a horizontal reciprocating motion in the left-right direction with respect to the figures from the initial position shown in FIG. 1** (as indicated by the arrow E).

Figure 2:
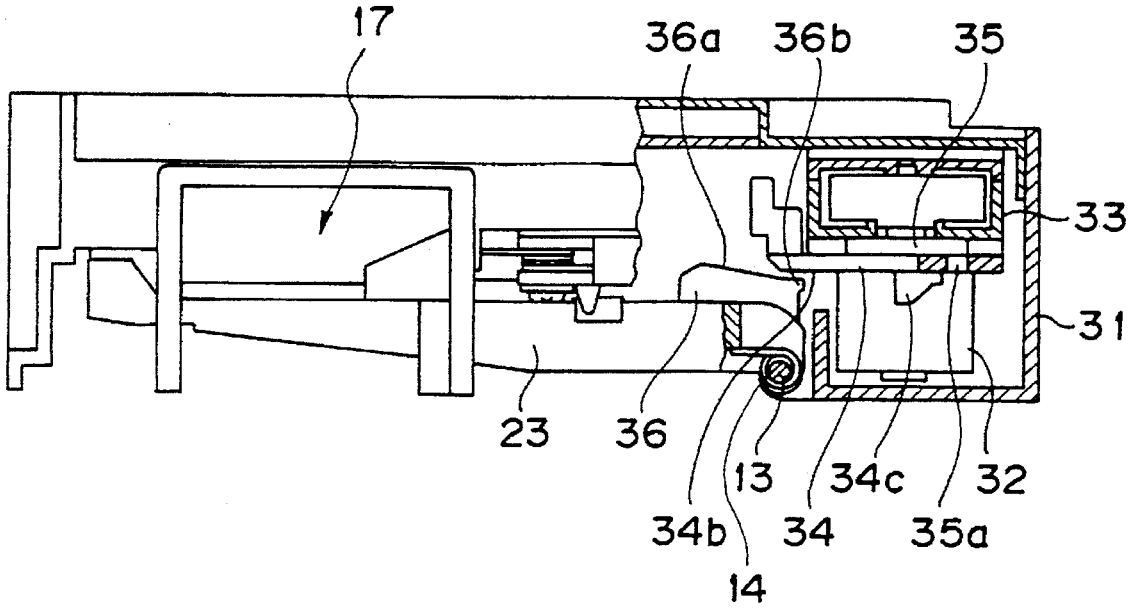
FIG. 2 is a plan view of the coin sorting device of FIG. 1.

As is shown in FIG. 2, which is a partially sectional plan view of FIG. 1, a tapered member 36 which has an inclined surface (inclined downward toward the right) that makes sliding contact with the tip end surface **34*b* of the gate arm 34 is formed as a protecting part on the back surface of the gate plate 23**.

Figure 3:
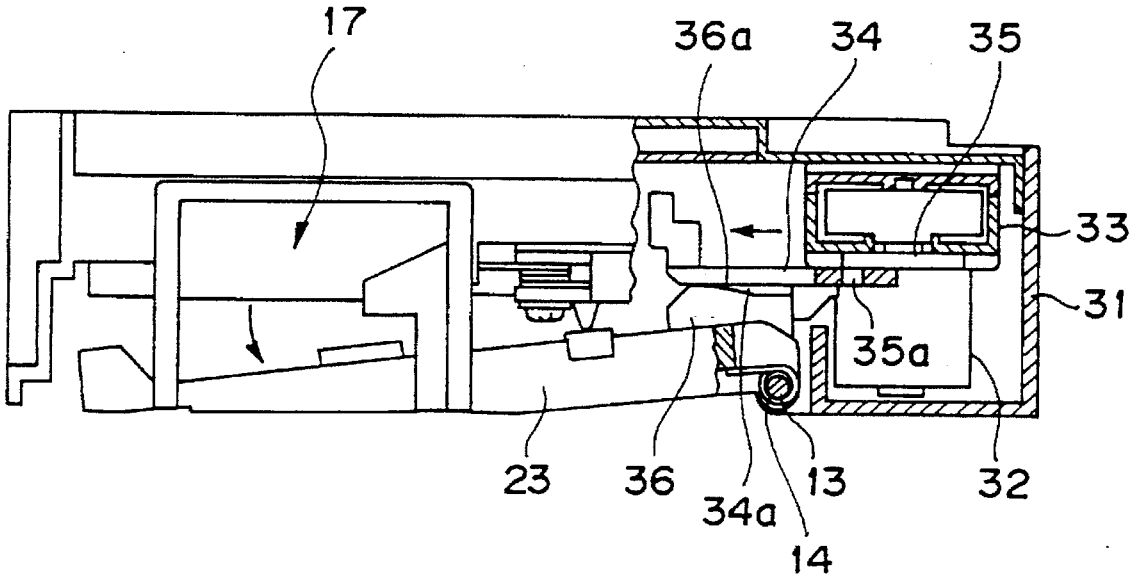
FIG. 3 is a plan view of the coin sorting device with a gate plate being opened.

As a result of the use of such a tapered member 36, when the pulley 35 completes a half-revolution as shown in FIG. 3 so that the gate arm 34 moves horizontally toward the left of the figure as indicated by the arrow, the partial force of the gate arm 34 which makes sliding contact with the inclined surface **36*a* of the tapered member 36 causes a force oriented in the counterclockwise direction about the shaft 13 to be applied to the gate plate 23. As a result, the gate plate 23 rotates in the counterclockwise direction about the shaft 13 so that the first coin passage 5 (FIG. 1**) is opened.

Since the gate arm 34 returns to the initial position shown in FIG. 2 when the pulley 35 completes one revolution, the return force of the coil spring 14 wound around the shaft 13 causes the gate plate to rotate in the clockwise direction about the shaft 13 so that the first coin passage (FIG. 1) is closed.

In the above embodiment, as is shown in FIG. 2, a projection **36*b* which projects substantially parallel to the gate plate 23, i.e., parallel to the direction of advance of the gate arm 34, is formed on the rear end of the tapered member 36, i.e., on the end where the shaft 13 which supports the gate plate 23 is located; furthermore, the projection 36***b* is formed in such a position that the projection 36*b* contacts a projection 34*c* formed on the base end portion of the gate arm 34.

Figure 4:
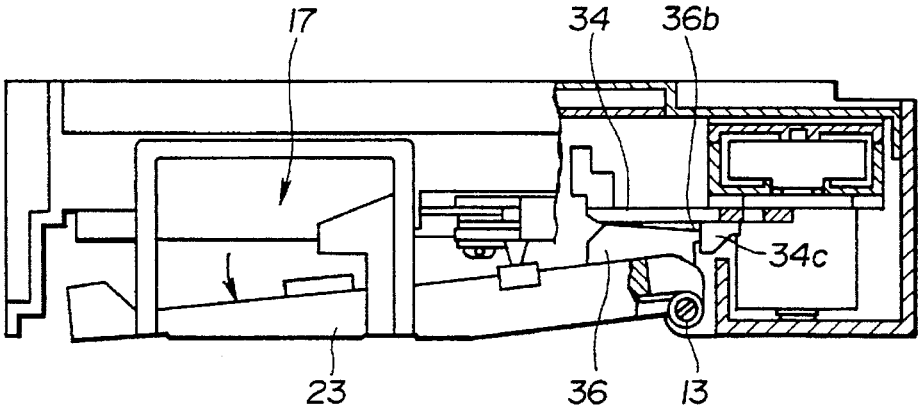
FIG. 4 is a plan view of the coin sorting device with the gate plate being further opened.

When a projection 36*b* is thus formed on the tapered member 36, and a projection 34*c* is formed on the base end portion of the gate arm 34 so that the two projections are caused to contact each other, a force which causes even further rotation in the counterclockwise direction about the shaft 13 is applied to the gate plate 23 so that the first coin passage 5 can be opened even further (as shown in FIG. 4).

The projection 36*b* formed on the tapered member 36 and the projection 34*c* formed on the gate arm 34 are both formed so that the amount of opening of the gate plate 23 can be reliably maintained.

Specifically, in cases where the gate plate 23 is opened about the shaft 13 only by the sliding contact action between the gate arm 34 and the tapered member 36, there is a danger that the amount of opening of the gate plate 23 cannot be sufficiently maintained due to manufacturing errors or the like in the respective parts. However, if a projection 36*b* is formed roughly parallel to the gate plate 23 on the rear end of the tapered member 36, and a projection 34*c* which contacts the projection 36*b* is formed on the base end portion of the gate arm 34 (as described above), the abovementioned manufacturing errors of the respective parts are absorbed, so that the horizontal movement stroke of the gate arm 36 is sufficiently transmitted to the gate plate 23, thus insuring that the amount of opening of the gate plate 23 can be sufficiently maintained.

In cases where the manufacturing errors of the respective parts are strictly controlled, the protection 36*b* on the tapered member 36 and the protection 34*c* on the gate arm 34 are naturally unnecessary, and may be omitted.

In the coin sorting device 21 of the present invention, an electronic coin discriminating means 6 which ascertains the genuineness of coins passing through and the denomination of genuine coins as in conventional devices is disposed at an intermediate point in the first coin passage 5 as shown in FIG. 1.

In the present invention, the electronic coin discriminating means 6 not only ascertains the genuineness of coins and the denominations of genuine coins, but also acts as a coin jamming detection sensor 40 which detects whether coins have become stuck at an intermediate point in the first coin passage 5.

Figure 12:
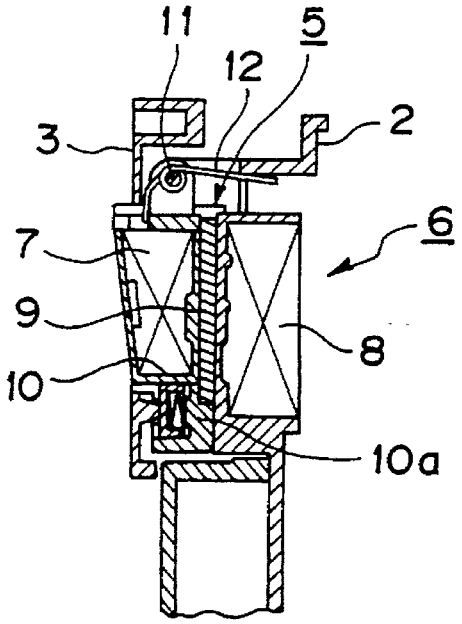
FIG.12 PRIOR ART
FIG. 12 is a schematic sectional view along line 12—12 in FIG. 10.
Figure 13:
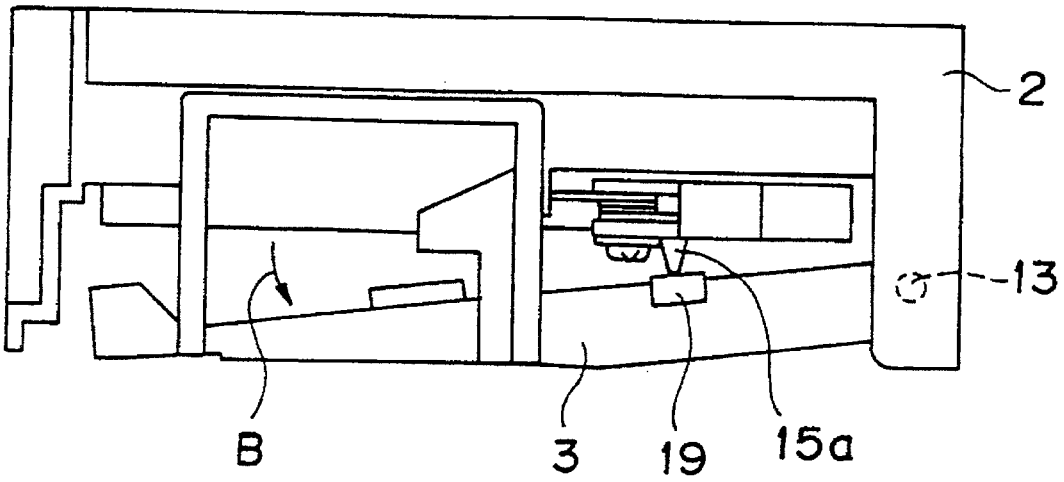
FIG.13 PRIOR ART
FIG. 13 is a plan view of FIG. 10, depicting the open state of the gate plate.
Figure 14:
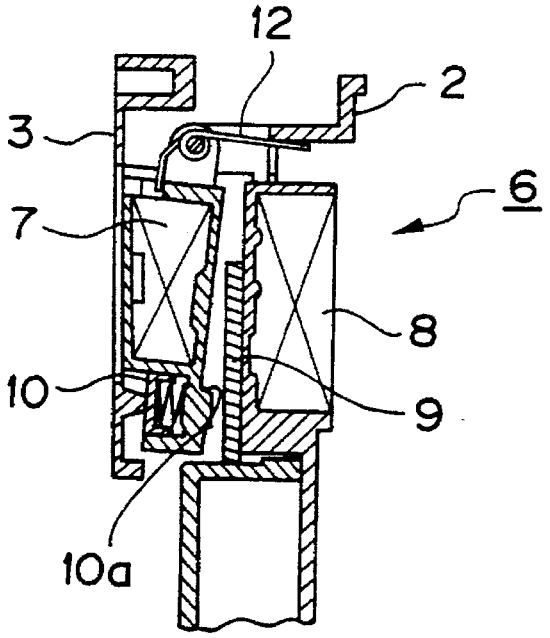
FIG.14 PRIOR ART
FIG. 14 is a schematic sectional view along line 12—12 in FIG. 10, depicting the open state of the gate plate.
Figure 15:
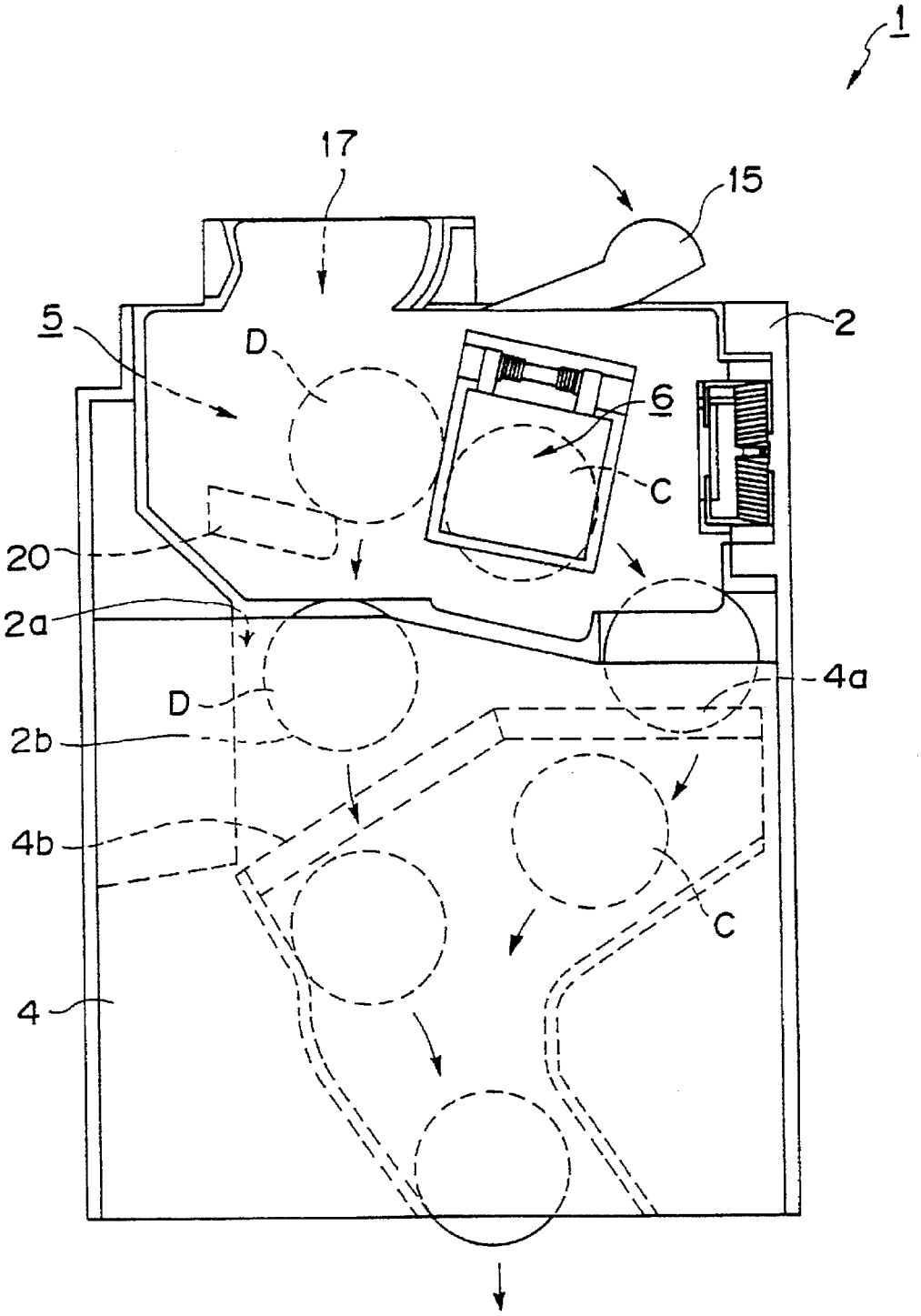
FIG.15 PRIOR ART
FIG. 15 is a front view of a conventional coin sorting device with the gate plate being opened.
Figure 16:
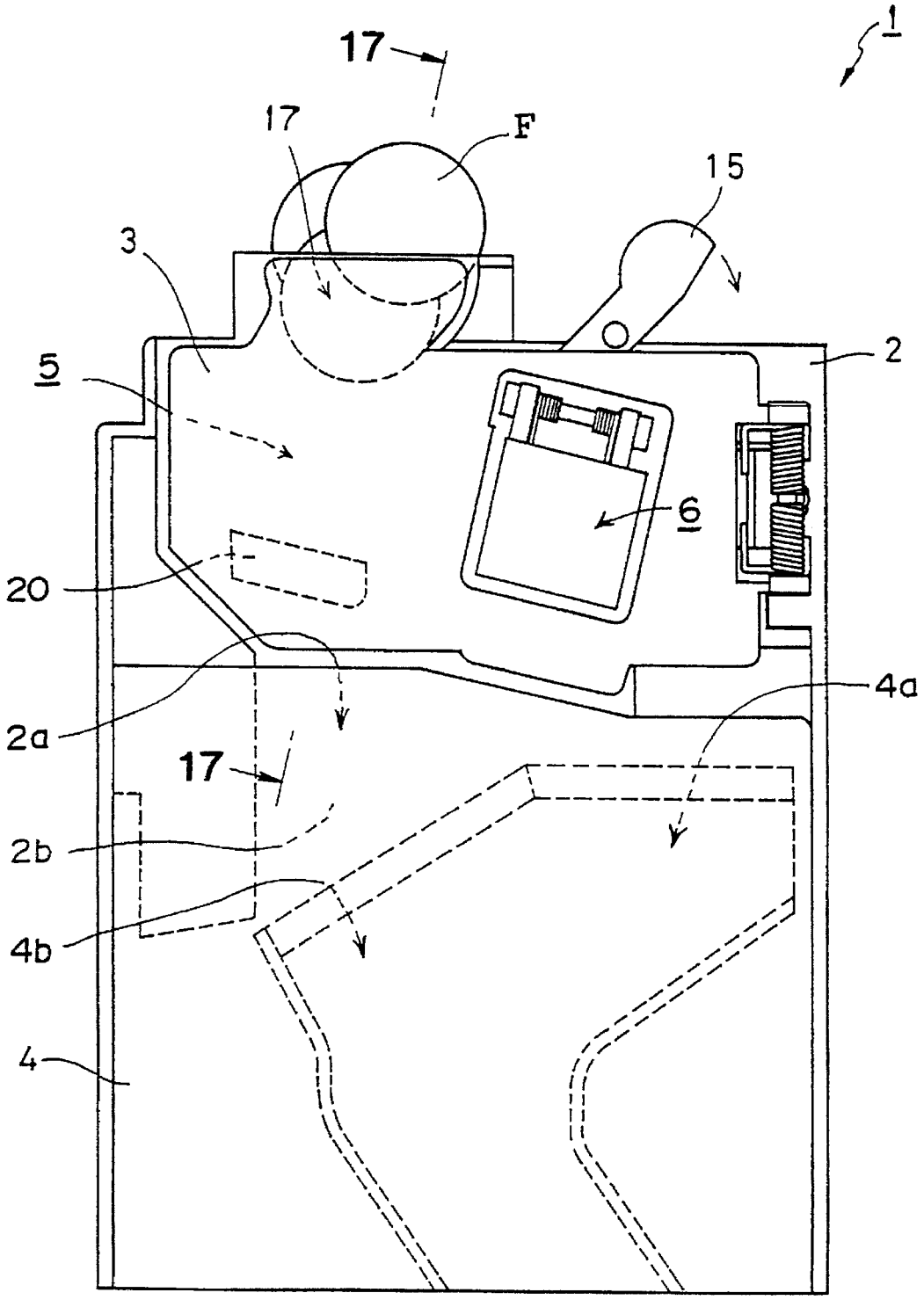
FIG.16 PRIOR ART
FIG. 16 is a front view of a coin sorting device, depicting a state in which coins are stuck in the coin insertion opening.
Figure 17:
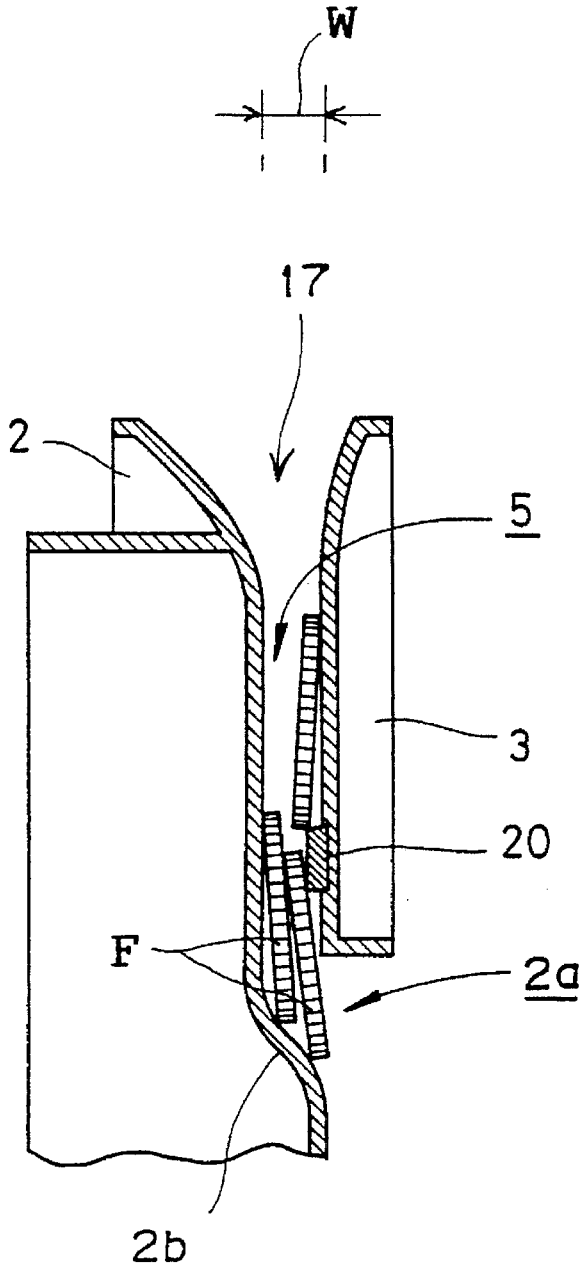
FIG.17 PRIOR ART
FIG. 17 is a schematic sectional view along line 16—16 in FIG. 16.

The construction of the electronic coin discriminating means 6 which acts as a coin jamming detection sensor 40 will be described in greater detail below:

As in the conventional device, the coin discriminating means 6 is constructed from an oscillating coil 7 and a receiving coil 8 which are installed on the sides of the first coin passage 5 with a prescribed gap left between the two coils (a gap which is sufficient to allow the passage of a single coin) (FIG. 12).

Figure 5:
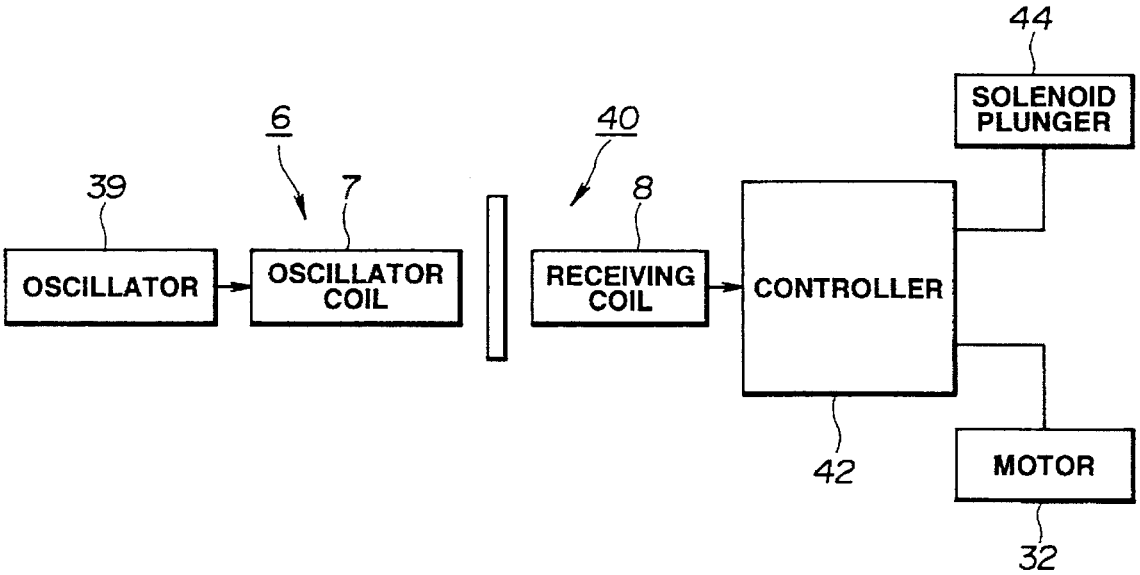
FIG. 5 is a block diagram depicting a coin jamming detection sensor.

Furthermore, as is shown in the block diagram in FIG. 5, the coin discriminating means 6 which acts as a coin jamming detection sensor 40 is constructed from a sensor part 41 consisting of an oscillator 39 and the oscillating coil 7 and receiving coil 8, and a controller 42 which (in accordance with detection signals from the sensor part 41) compares attenuation voltages and permissible ranges measured and stored beforehand for each coin with received voltages sent from the sensor part 41, judges the genuineness of coins and the denominations of genuine coins based on the results of these comparisons, and judges that coin jamming has occurred in the sensor part 41 in cases where the attenuation voltage shows no change for a given period of time.

In the ordinary operation of such a controller 42, the genuineness of coins passing through and the denominations of genuine coins are ascertained, and driving signals are sent out to a solenoid plunger 44 which drives the coin distributing levers. On the other hand, in cases where there is no change in the attenuation voltage for a given period of time, a driving signal is sent to the motor 32 which is a constituent element of the gate plate opening means 30.

Next, the operation of the coin sorting device 21 will be described, and the construction of the device will also be described in greater detail.

Ordinarily, as is shown in FIG. 1, when coins are inserted into the coin insertion opening 17, the genuineness of the coins and the denominations of genuine coins are ascertained by the coin discriminating means 6, and each coin thus discriminated is sorted by being guided into one of the plurality of coin passages formed between the lower portion of the main body 22 and the front cover 4 which covers the lower portion of the main body 22.

On the other hand, as is also shown in FIG. 1, when a coin C passing through the first coin passage 5 becomes stuck in the area of the coin discriminating means 6 as a result of deformation, soiling or the like, and a prescribed period of time passes following this sticking of the coin C, the controller 42 of the coin discriminating means 6 which acts as a coin jamming detection sensor 40 judges that a coin has become stuck in the area of the coin discriminating means 6, and sends out a driving signal to the motor 32 which is a constituent element of the gate plate opening means 30.

When a driving signal is thus sent out to the motor 32 of the gate plate opening means 30, the pulley 35 of the gate plate opening means 30 completes a half-revolution as shown in FIG. 3. As a result, the gate arm 34 is caused to move horizontally to the left in the figure as indicated by the arrow, thus causing the tip end surface 34*a* of the gate arm 34 to make sliding contact with the inclined surface 36*a* of the tapered member 36. Furthermore, as is shown in FIG. 4, the protection 36*b* formed on the rear end of the tapered member 36 contacts the projection 34*c* formed on the base end portion of the gate arm 34, so that the gate plate 23 is caused to rotate more reliably and by a greater amount in the counterclockwise direction about the shaft 13.

Figure 6:
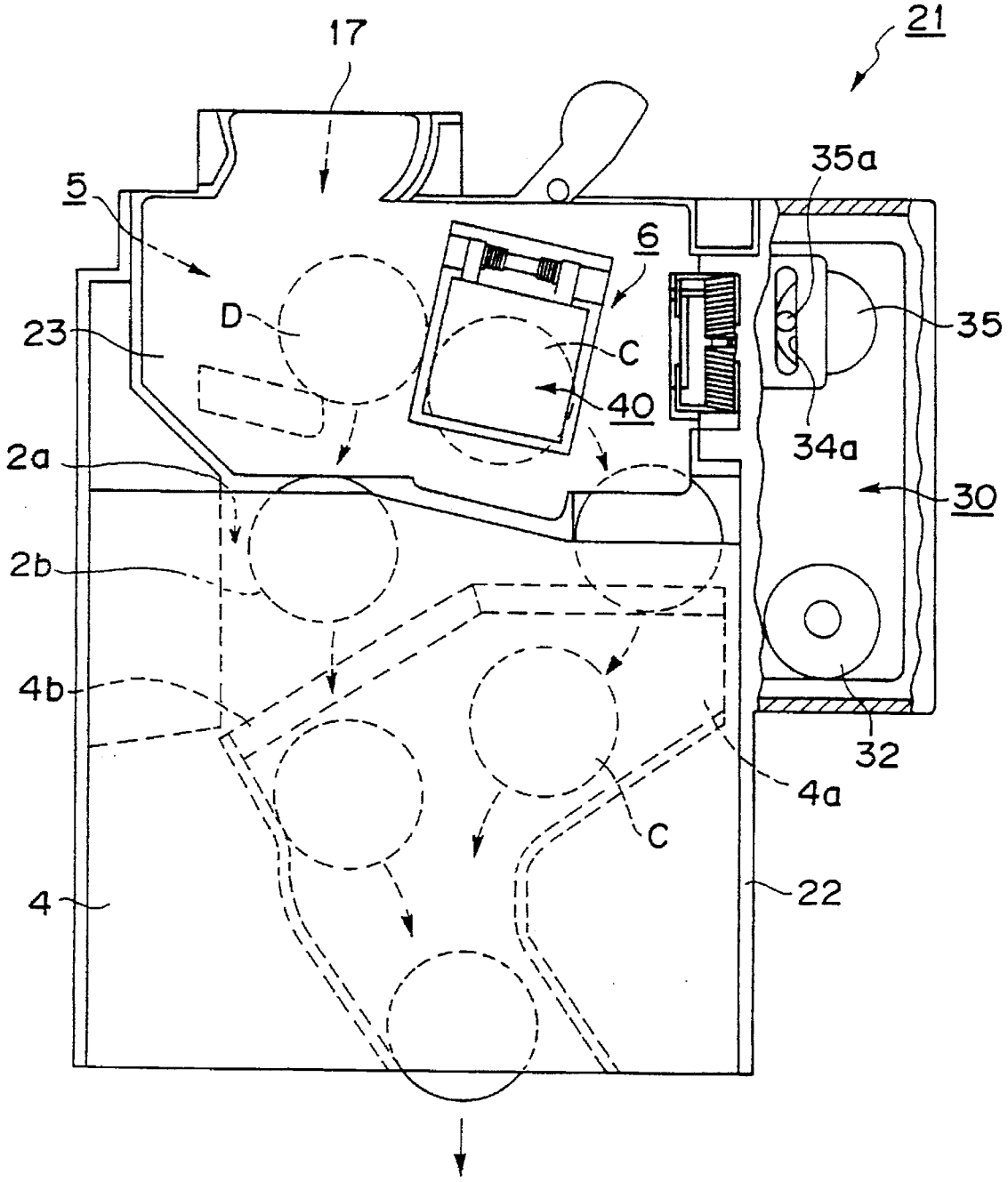
FIG. 6 is a partially sectional front view of the coin sorting device with the gate plate being opened.

As is shown in FIG. 6, when the gate plate 23 is thus widely opened by the gate arm 34 of the gate plate opening means 30, the coin C stuck in the coin discriminating means 6, and the following stuck coin D, drop downward from the bottom surface of the first coin passage 5; furthermore, these dropped coins pass through the bent portion 2*b* of the coin return passage 2*a*, and are captured in the coin discharge chutes 4*b*, 4*a* formed in the front cover 4 which covers the lower portion of the main body 22. The coins are then discharged via the coin discharge opening (not shown in the figures) formed in the device in question (that is, an automatic vending machine or the like).

When the pulley 35 completes one revolution and thus returns to the initial position shown in FIG. 2, the gate plate 23 also simultaneously rotates in the clockwise direction about the shaft 13 so that the first coin passage 5 is returned to the closed initial position as shown in FIG. 1, and thus returns to a waiting attitude for processing the next inserted coin.

In the coin sorting device 21 described above, when a coin becomes stuck in the coin passage 5, the stuck coin is detected and the gate plate 23 is automatically opened so that the stuck coin is automatically discharged by being caused to drop downward. Accordingly, the jamming of a plurality of coins in the coin passage 5 as a result of the user not noticing that a coin has become stuck can be avoided. As a result, a coin sorting device which maintains a stable function over a long period of time can be provided.

Furthermore, in the coin sorting device 21 described above, particularly since the gate plate opening means 30 is constructed from a tapered member 36 formed on the back surface of the gate plate 23, a gate arm 34 which makes sliding contact with the tapered member 36, a projection 34*c* formed on the base end portion of the gate arm 34, and a projection 36*b* which is formed on the tapered member 36 so that the projection 36*b* protrudes toward the base end portion of the gate arm 34, and since the gate plate opening means 30 is designed so that the projection 34*c* on the gate arm 34 is caused to contact the projection 36*b* on the tapered member 36 when the gate arm 34 performs a reciprocating motion, finishing errors in the vicinity of the gate plate 23 can be effectively absorbed so that the opening angle of the gate plate 23 can be maintained at a large value, thus making it possible to achieve the stable release of coins stuck in the coin passage 5.

Furthermore, in the coin sorting device 21 described above, as is shown in FIG. 7 (in which parts that are the same as in FIG. 6 are indicated by the same symbols), a step portion 25 which strikes against the rim portion of at least one coin among a plurality of coins which simultaneously drop downward while overlapping in the direction of thickness is formed beneath the first coin passage 5 in order to eliminate coin jamming caused by the bent portion 2*b* of the return passage 2*a* positioned beneath the coin insertion opening 17.

Next, the step portion 25 formed inside the coin sorting device 21 will be described.

Figure 7:
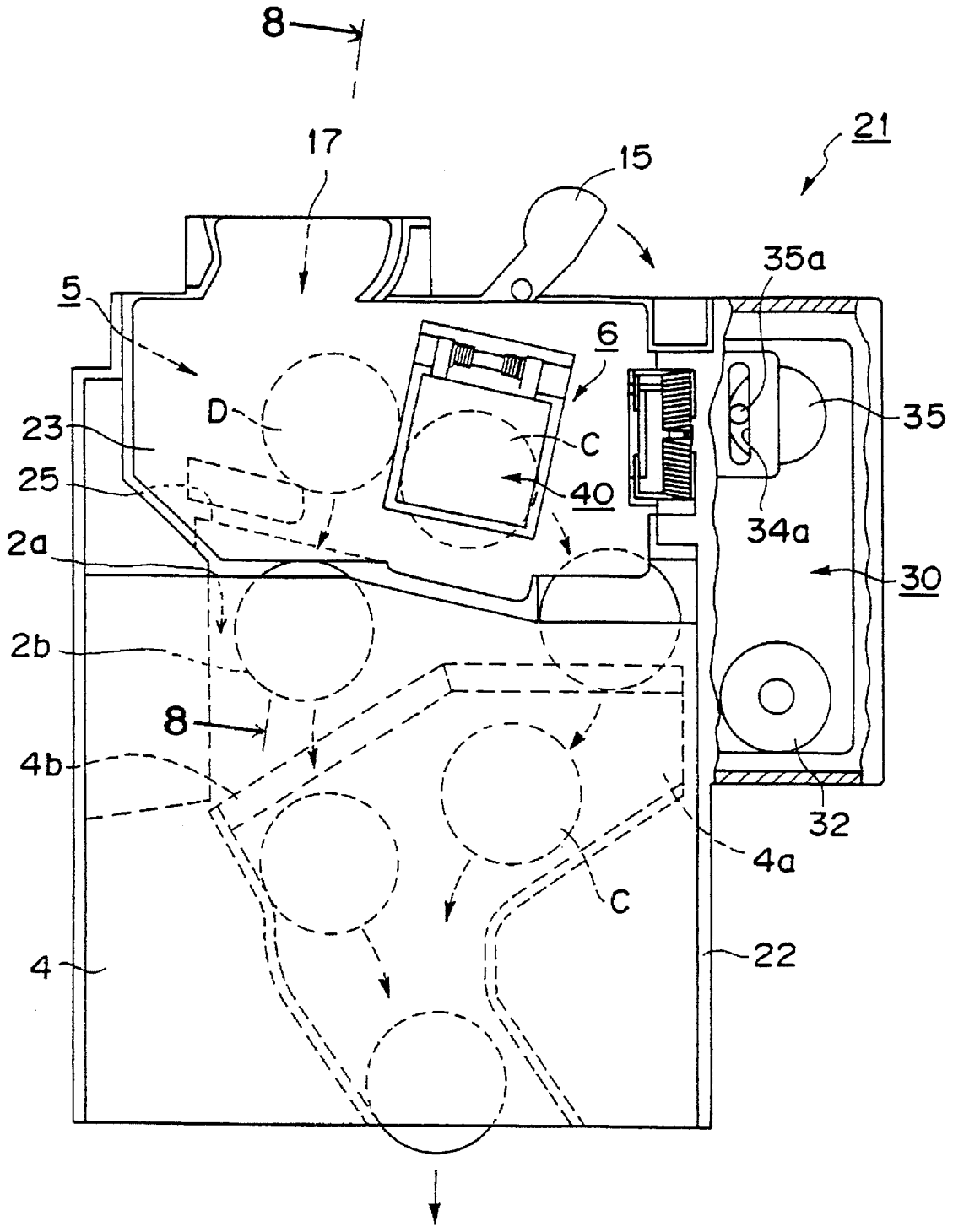
FIG. 7 is a partially sectional front view of the coin sorting device with the gate plate being opened.
Figure 8:
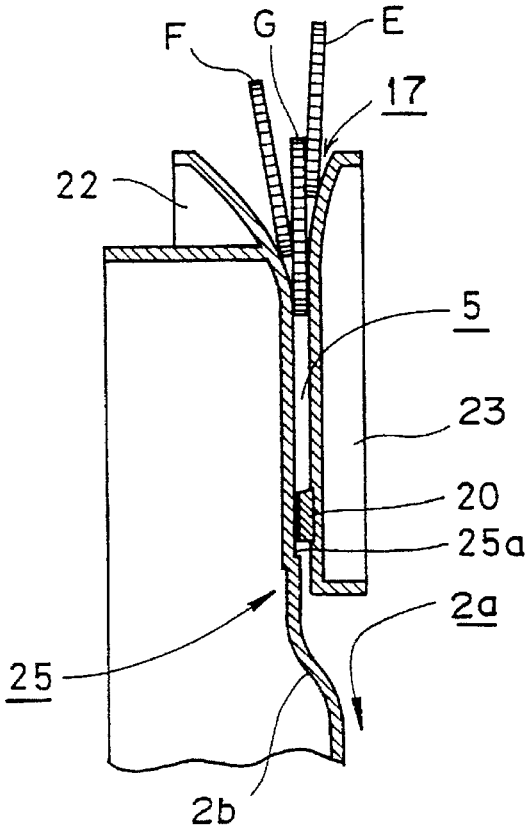
FIG. 8 is a schematic sectional view along line 8—8 in FIG. 7.

FIG. 8 is a schematic sectional view along line CC in FIG. 7, and depicts the closed state of the gate plate 23.

As is shown in FIG. 8, the step portion 25 is formed upstream from the projecting bent portion 2*b* of the return passage 2*a*, and is formed as an integral part of the main body 22 which constitutes the left side surface of the first coin passage 5.

As is shown in FIG. 7, the step portion 25 is formed so that the step portion 25 is inclined downward toward the right (with respect to FIG. 7) along the wall surface of the main body 22. Moreover, the protruding length (step) of the upper end 25*a* of the step portion 25 can be appropriately set in accordance with the thickness of the coins inserted.

Next, the action of the step portion 25 in a case where a plurality of coins stuck in the coin insertion opening 17 are caused to drop downward will be described.

Here, it is assumed that a plurality of coins E, F, G have become stuck in the entrance portion of the coin insertion opening 17.

In this case, when the gate plate 23 is forcibly opened as a result of the user's manipulation of the gate lever 15 shown in FIG. 1, or by the gate plate opening means 30, the entire bottom surface of the coin insertion opening 17 and first coin passage 5 is opened, so that the coins E, F, G stuck in the entrance portion of the coin insertion opening 17 drop downward toward the bottom surface of the first coin passage 5.

If the coins F and G drop downward simultaneously while overlapping in the direction of thickness, the rim portion of the coin F passing through on the main body side will strike the upper end 25*a* of the step portion 25, and will thus be temporarily halted at the step portion 25, so that the overlapping of the two coins F, G is broken.

Figure 9:
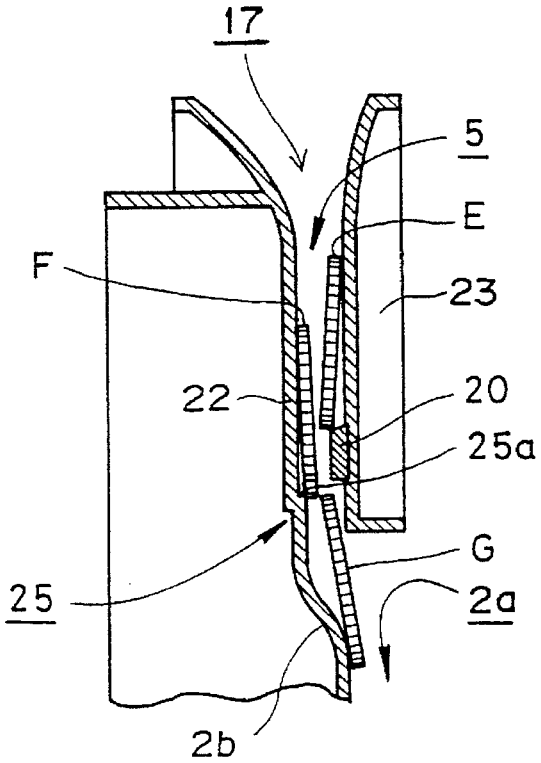
FIG. 9 is a schematic sectional view along line 8—8 in FIG. 7, depicting the open state of the gate plate.
Figure 10:
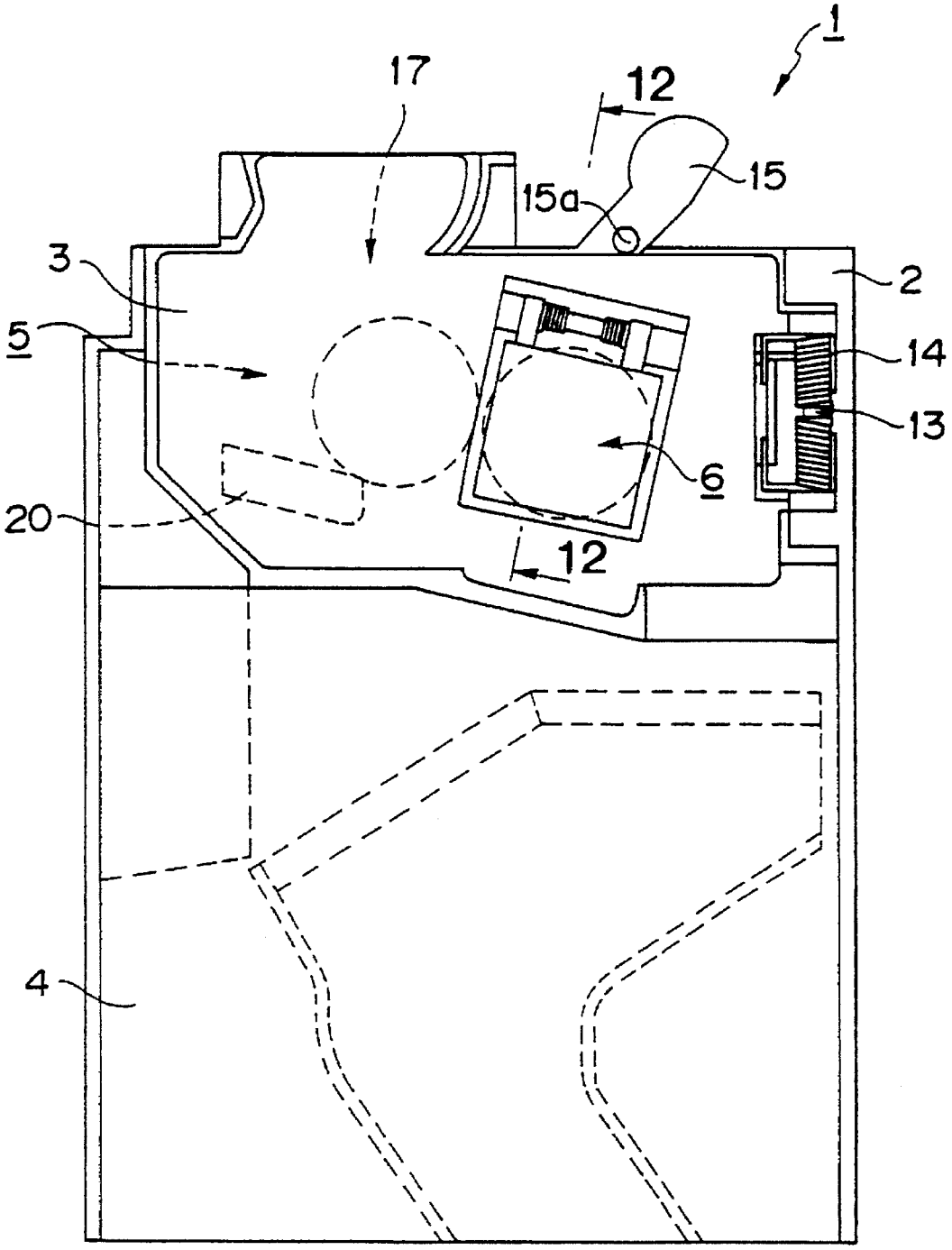
FIG.10 PRIOR ART
FIG. 10 is a partially sectional front view depicting a conventional coin sorting device.
Figure 11:
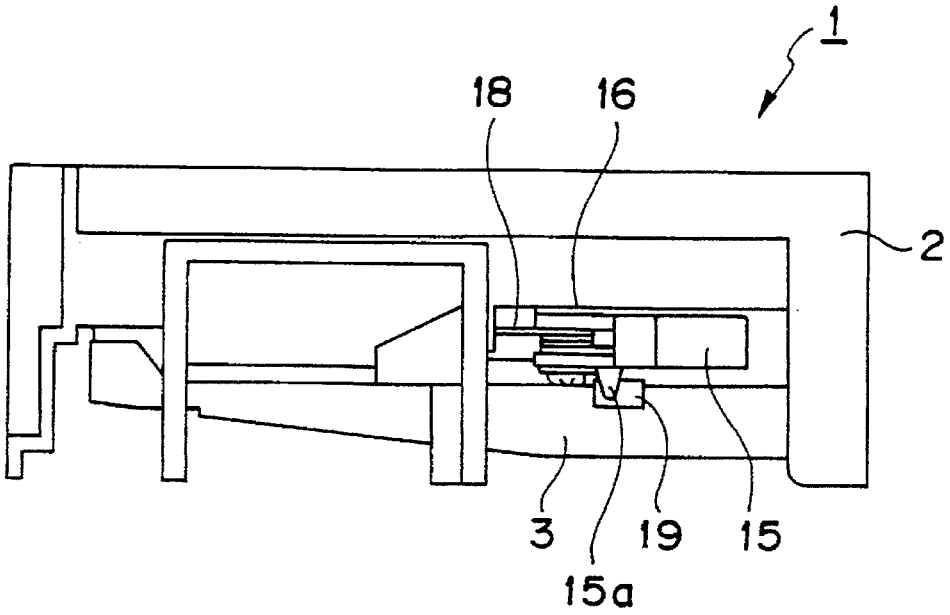
FIG.11 PRIOR ART
FIG. 11 is a plan view of the coin sorting device of FIG. 10.

Accordingly, as is shown in FIG. 9, even if two coins drop downward simultaneously while overlapping with each other, the coins are prevented from dropping downward in an overlapping state inside the return passage 2*a* located downstream from the step portion 25. As a result, the coin G will pass through the bent portion 2*b* of the return passage 2*a* first, after which the coin F which has struck the step portion 25 and the coin E which has struck the gate rail 20 will pass smoothly through the bent portion 2*b* in that order.

Thus, even in cases where the gate plate 23 cannot be sufficiently opened in the direction of depth, the rim portion of at least one of a plurality of coins dropping downward while overlapping in the direction of thickness will strike the step portion 25 so that the overlapping of the coins is broken. As a result, the coins will pass smoothly through the bent portion 2*b* of the return passage 2*a*, so that coin jamming in this area is effectively prevented.

In the embodiment described above, the step portion 25 was formed as an integral part of the main body 22; however, it would also be possible to install the step portion 25 on the wall surface of the main body 22 as a separate part.

The step portion 25 in the embodiment described above was formed as a uniform rail-shaped part with no openings (as is shown in FIG. 7); however, it would also be possible to form grooves at a prescribed pitch in the step portion 25. Specifically, a plurality of liquid guide grooves (not shown in the figures) are formed in the bent portion 2*b* of the return passage 2*a*; if grooves are formed at a prescribed pitch in the step portion 25 so that these grooves correspond to the liquid guide grooves, then any liquid which might enter via the coin insertion opening 17 can be smoothly guided into the liquid capturing part (not shown in the figures) formed below.

Accordingly, in the coin sorting device 21 described above, a step portion 25 which strikes the rim portion of at least one of a plurality of coins dropping downward while overlapping in the direction of thickness is disposed on the side of the main body 22 beneath the coin passage 5, so that the overlapping of the coins is broken by this step portion 25. As a result, even in cases where coins drop downward while overlapping in the direction of thickness, the coins will pass smoothly through the return passage 2*a* one at a time, so that coin jamming in this area can be effectively prevented. Thus, coins stuck inside the coin insertion opening 17 can be quickly and reliably released.

The present invention can be worked in various other configurations without departing from the spirit or principal characteristic features of the present invention. Accordingly, the embodiment described above is in all respects merely an example, and must not be interpreted as limiting the present invention. The scope of the present invention is indicated by the claims, and is not restricted in any way by the text of the specification. Furthermore, all modifications or alterations within a scope equal to the scope of the claims are within the scope of the present invention.

What is claimed is:

1. A coin sorting device comprising a coin passage for guiding coins inserted via a coin insertion opening, and a gate plate for opening and closing this coin passage, characterized by:

a coin jamming detection sensor provided at an intermediate point in the coin passage, for detecting jamming of coins passing through the coin passage; and gate plate opening means comprising:

driving means comprising a motor which is actuated based on a detection signal of the detection sensor, an arm member which is driven by the driving means to perform a reciprocating motion in the horizontal direction;

a projection formed on a base end portion of the arm member;

a tapered member formed on a back surface of the gate plate, for opening the gate plate by making sliding contact therewith when the arm member performs a reciprocating motion; and a projection formed on the tapered member so as to project toward the base end portion of the arm member, for opening the gate plate even further by contacting the projection formed on the base end portion of the arm member when the arm member performs a reciprocating motion.

2. A coin sorting device according to claim 1, wherein the coin jamming detection sensor comprises:

coin discriminating means disposed at an intermediate point in the coin passage, for ascertaining genuineness of inserted coins and denominations of genuine coins; and a controller for judging whether or not coin jamming has occurred in the coin discriminating means based on a detection signal from the coin discriminating means, and for sending an actuating signal to the gate plate opening means in cases where it is judged that coin jamming has occurred in the coin discriminating means.

3. A coin sorting device comprising a main body and a gate plate for covering the upper front portion of the main body such that the gate plate can be opened and closed, and a coin passage provided between the main body and the gate plate for guiding coins inserted via a coin insertion opening, wherein coins stuck in the coin passage are released by opening the gate plate so that the coins are caused to drop downward, characterized by:

a coin jamming detection sensor provided at an intermediate point in the coin passage, for detecting the jamming of coins passing through the coin passage;

gate plate opening means comprising:

driving means comprising a motor which is actuated based on a detection signal of the detection sensor, an arm member which is driven by the driving means to perform a reciprocating motion in the horizontal direction;

a projection formed on a base end portion of the arm member;

a tapered member formed on a back surface of the gate plate, for opening the gate plate by making sliding contact therewith when the arm member performs a reciprocating motion; and a projection formed on the tapered member so as to project toward the base end portion of the arm member, for opening the gate plate even further by contacting the projection formed on the base end portion of the arm member when the arm member performs a reciprocating motion; and a step portion formed in the surface of the main body beneath the coin passage positioned directly underneath the coin insertion opening, the step portion being caused to strike at least one coin among a plurality of coins dropping downward from the coin insertion opening while overlapping in the direction of thickness.

4. A coin sorting device according to claim 3, wherein the coin jamming detection sensor comprises:

coin discriminating means disposed at an intermediate point in the coin passage, for ascertaining genuineness of inserted coins and denominations of genuine coins; and a controller for judging whether or not coin jamming has occurred in the coin discriminating means based on a detection signal from the coin discriminating means, and for sending an actuating signal to the gate plate opening means in cases where it is judged that coin jamming has occurred in the coin discriminating means.

* * * * *